US005666625A

United States Patent [19]

Komatsubara et al.

[11] Patent Number: 5,666,625

[45] Date of Patent: Sep. 9, 1997

[54] DEVICE FOR ELECTROSTATICALLY DEVELOPING A LATENT IMAGE ON AN IMAGE CARRIER

[75] Inventors: Satoru Komatsubara, Atsugi; Kazuhiro Yuasa, Zama; Shuichi Endoh, Isehara; Iwao Matsumae, Tokyo; Yoshiaki Tanaka, Kawasaki; Hiroshi Hosokawa, Yokohama; Mugijiro Uno, Isehara; Hiroshi Saitoh, Ayase; Eiji Takenaka, Isehara; Toshihiro Sugiyama, Atsugi; Tetsuo Yamanaka, Tokyo; Eisaku Murakami, Hiratsuka, all of Japan

[73] Assignee: Ricoh Company, Ltd., Tokyo, Japan

[21] Appl. No.: 560,977

[22] Filed: Nov. 20, 1995

[30] Foreign Application Priority Data

Nov. 23, 1994 [JP] Japan ..... 6-314090

[51] Int. Cl.[6] ..... G03G 15/08

[52] U.S. Cl. ..... 399/281; 430/120

[58] Field of Search ..... 355/259, 253; 118/653, 657; 430/110, 111, 120; 399/279, 281, 282

[56] References Cited

U.S. PATENT DOCUMENTS 4,537,491 8/1985 Komada et al. .
5,126,799 6/1992 Matsuura et al. .
5,212,521 5/1993 Ogawa et al. .
5,223,668 6/1993 Takaya et al. .
5,287,151 2/1994 Sugiyama .
5,289,241 2/1994 Sugiyama et al. .
5,315,357 5/1994 Kamijo et al. .
5,389,733 2/1995 Enoki et al. .
5,486,909 1/1996 Takenaka et al. .
5,489,747 2/1996 Takenaka et al. .

FOREIGN PATENT DOCUMENTS 6-175477 6/1994 Japan ..... 355/259

*Primary Examiner*—Joan H. Pendegrass
*Attorney, Agent, or Firm*—Oblon, Spivak, McClelland, Maier & Neustadt, P.C.

[57] ABSTRACT

In an image forming apparatus, a developing device has a first developer carrier for depositing a developer thereon, a regulating member for regulating the amount of the developer deposited on the first developer carrier, and a second developer carrier having an elastic surface, and contacting the first developer carrier while biting into it by a predetermined amount. The developer is provided with a preselected degree of fluidity. Hence, even when the same portion of the surface of the second developer carrier runs a plurality of times past a position where the two developer carriers contact each other without any developer being fed from the second developer carrier to an image carrier, the first developer carrier can surely strip the developer from the second developer carrier. As a result, a developer on which a predetermined amount of charge is deposited is transferred from the first developer carrier to the second developer carrier. This successfully protects images from defects. Particularly, when the developer has a zinc stearate content of greater than 0.1 wt %, it is possible to prevent the developer from melting and adhering to a member which regulates the developer.

4 Claims, 6 Drawing Sheets

DEVICE FOR ELECTROSTATICALLY DEVELOPING A LATENT IMAGE ON AN IMAGE CARRIER

BACKGROUND OF THE INVENTION

The present invention relates to a developing device for a copier, facsimile apparatus, printer or similar image forming apparatus. More particularly, the present invention is concerned with a developing device of the type transferring a developer deposited on a first developer carrier and leveled by a regulating member to a second developer carrier, and then feeding it to an image carrier in order to develop a latent image formed on the image carrier.

Generally, a developing system for an image forming apparatus uses either a one-ingredient type or a two-ingredient type developer. The one-ingredient type developer is magnetic toner having high electric resistance while the two-ingredient type developer is a mixture of nonmagnetic toner and carrier particles for depositing charge on the toner. Most of miniature laser printers extensively used today are implemented by the one-ingredient type developer or magnetic toner. A system using the magnetic toner is advantageous over a system using the toner and carrier mixture in that it reduces the cost and size of the apparatus. However, the problem with the magnetic toner scheme is that it is difficult to uniformly charge its particles, i.e., the toner includes particles charged to a polarity opposite to an expected polarity. The particles charged to the opposite polarity deposit on and smear, e.g., the non-image area or background of an image carrier.

In order to protect the background from contamination due to the above undesirable toner particles, Japanese Patent Laid-Open Publication No. 61-34557 discloses a developing system having a first and a second developer carrier. Magnetic toner charged by friction or charge injection is deposited on and conveyed by the first developer carrier and then transferred to the second developer carrier by an electric force. The second developer carrier conveys the toner to a developing position where it faces an image carrier. Japanese Patent Laid-Open Publication No. 6-222657 teaches an electrophotographic recording apparatus having a second developer carrier implemented as a belt and interposed between a first developer carrier and an image carrier. In these conventional schemes, among charged toner particles deposited on the first developer carrier, particles charged to a preselected polarity are transferred to the second developer carrier. As a result, the amount of particles of the opposite polarity and conveyed to the image carrier is successfully reduced. The background of the image carrier, therefore, suffers from a minimum of contamination attributable to the undesirable particles.

The above documents also teach that the second image carrier bite into the first developer carrier at least during the course of image formation. In this condition, the toner on the second developer carrier and varied in charge condition due to friction between it and the image carrier is stripped off by the first developer carrier at a nip between the two developer carriers. As a result, toner of the expected charge is fed to the second developer carrier and obviates defective images. The documents further teach that when the surface roughness of the first developer carrier is selected to be less than 10 μm Rz inclusive in terms of a ten-point mean value as prescribed by JIS (Japanese Industrial Standards), the toner can be adequately charged and also eliminates defective images including an image with a smeared background.

However, experiments showed that when the same part of the surface of the second developer carrier runs past the nip between the first and second developer carriers a number of times without any developer being fed from the second developer carrier to the image carrier, the toner deposited on the second developer carrier sometimes cannot be sufficiently stripped off by the first developer carrier. Hence, the amount of toner on the second developer carrier sequentially increases. As a result, at the beginning of the subsequent image formation, an excessive amount of toner is fed to the image carrier and increases the density of the initially developed portion of an image.

SUMMARY OF THE INVENTION

It is, therefore, an object of the present invention to provide a developing device for an image forming apparatus and capable of insuring the removal of the developer from a second developer carrier and thereby eliminating defective images even when the same part of the surface of the second developer carrier passes the nip between it and a first developer carrier a number of times without any developer being fed from the second developer carrier to an image carrier.

In accordance with the present invention, a device for developing a latent image electrostatically formed on an image carrier has a first developer carrier for depositing a developer thereon, a regulating member for regulating the amount of the developer deposited on the first developer carrier, and a second developer carrier having an elastic surface, and contacting the first developer carrier while biting thereinto by a predetermined amount. The developer deposited on the first developer carrier and regulated by the regulating member is transferred to the second developer carrier and fed from the second developer carrier to the image carrier for thereby developing the latent image. The developer contains coarse particles greater in size than 12 μm inclusive in a content of less than 10 vol % inclusive when the developer has a silica content of less than 2 wt % inclusive and a zinc stearate content of less than 2 wt % inclusive, when the first developer carrier has a surface roughness of less than 10 μm Rz inclusive in terms of the ten-point mean value as prescribed by JIS, and when the first and second developer carriers bite into each other by 0.1 mm to 0.5 mm.

Also, in accordance with the present invention, in a device of the type described, the developer has a silica content of greater than 0.2 wt % inclusive when the developer contains coarse particles greater in size than 12 μm inclusive in a content of less than 15 vol % inclusive and has a zinc stearate content of less than 2 wt % inclusive, when the first developer carrier has a surface roughness of less than 10 μm Rz inclusive in terms of the ten-point mean value, and when the first and second developer carriers bite into each other by 0.1 mm to 0.5 mm.

Further, in accordance with the present invention, in a device of the type described, the developer has a zinc stearate content of less than 1.0 wt % inclusive when the developer contains coarse particles greater in size than 12 μm inclusive in a content of less than 15 vol % inclusive and has a silica content of less than 2 wt % inclusive, when the first developer carrier has a surface roughness of less than 10 μm Rz inclusive in terms of the ten-point mean value, and when the first and second developer carriers bite into each other by 0.1 mm to 0.5 mm.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
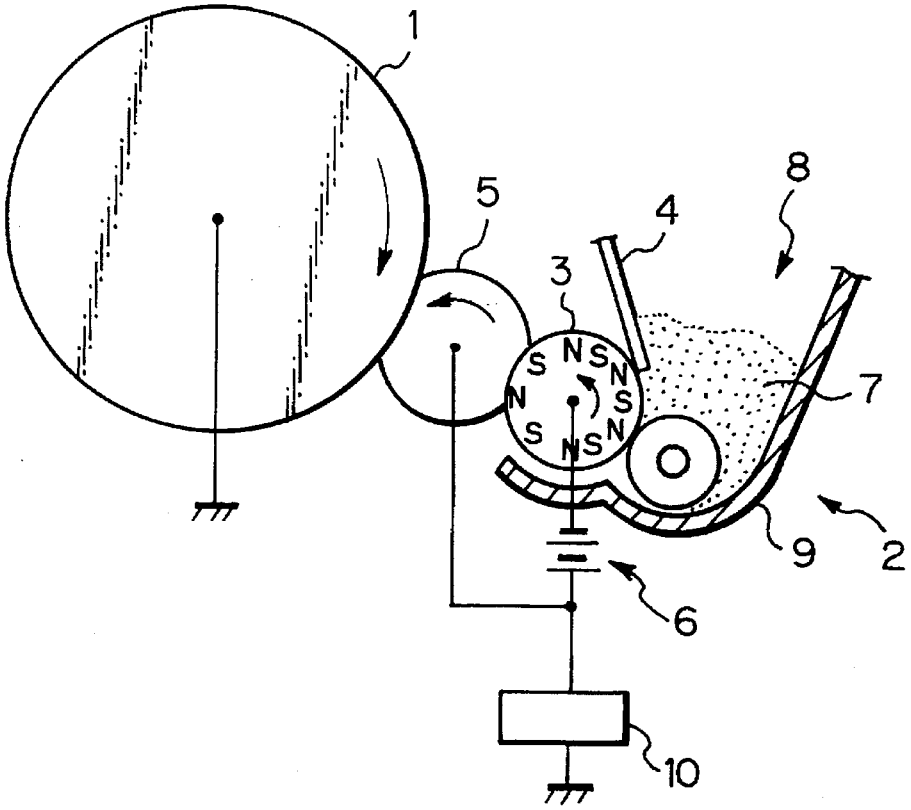
FIG. 1 is a section showing a developing device embodying the present invention.

Referring to FIG. 1 of the drawings, a developing device embodying the present invention is shown and applied to an electrophotographic copier by way of example. As shown, an image carrier is implemented as a photoconductive drum 1 made up of a metallic core and a photoconductive layer covering the core. While the drum 1 is rotated in a direction indicated by an arrow, a latent image is electrostatically formed on the drum 1 by a charger, exposing device, etc., not shown. A developing device 2 adjoins the drum 1 and has a first developing roller or developer carrier 3, a doctor blade or regulating member 4, a second developing roller or developer carrier 5, and a DC power source or potential difference generating means 6. The developing roller 3 carries a developer thereon which is magnetic toner and will, therefore, be referred to as toner hereinafter. The doctor blade 4 regulates the amount of toner magnetically deposited on the developing roller. The developing roller 5 is pressed against the developing roller 3 by a predetermined pressure. The DC power source 6 generates a predetermined potential difference between the rollers 3 and 5. Further, the device 2 has a hopper 8 storing toner 7, a replenishing roller 9 for replenishing the toner 7 from the hopper 8 to the developing roller 3, and a high-tension power source 10 for forming an electric field for development between the drum 1 and the developing roller 5. The drum 1 has its core connected to ground.

The roller 3 is relatively hard and has its surface magnetized at a predetermined pitch. The roller 3 is rotatable in a direction indicated by an arrow in FIG. 1. The doctor blade 4 is elastic and held in contact with the surface of the roller 3, as illustrated. The other roller 5 is relatively soft and has a surface formed of conductive rubber or similar elastic material. The roller 5 is rotatable in a direction indicated by an arrow, while pressing against each of the drum 1 and roller 3 with a particular pressure. The two rollers 3 and 5 bite into each other by 0.25±0.10 mm. The amount of bite has a lower limit selected such that when use is made of standard toner, a toner stripping effect which will be described is achievable, and an upper limit selected such that the rollers 3 and 5 can be driven by a torque smaller than predetermined one.

The soft roller 5 allows the image carrier to be implemented by the inexpensive drum 1. The drum 1, in turn, noticeably reduces the production cost of the arrangement around the drum 1, compared to a photoconductive belt.

In operation, the toner 7 is conveyed from the hopper 8 to the vicinity of the roller 3 and then magnetically deposited on the roller 3. While the roller 3 with the toner 7 is rotated, the doctor blade 7 levels the toner 7 while charging it to a predetermined polarity (negative polarity in the embodiment). As a result, the toner 7 forms a uniform thin layer on the roller 3.

Figure 2:
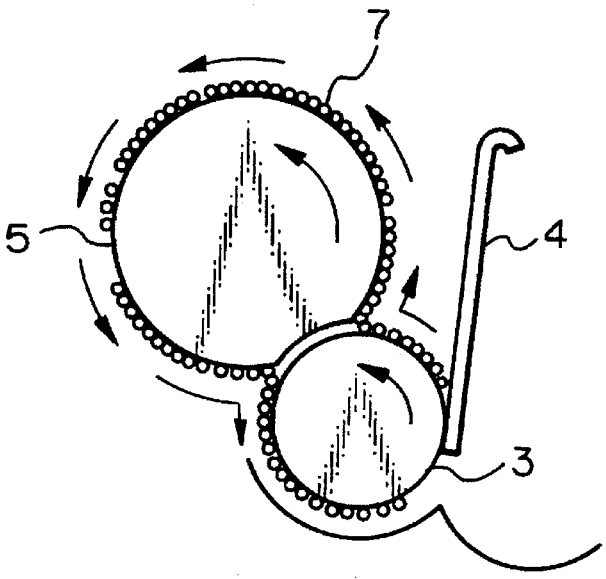
FIG. 2 demonstrates the movement of toner to occur when the device of FIG. 1 is in operation.

A potential difference generated between the developing rollers 3 and 5 by the DC power source 6 forms an electric field such that the toner 7 is transferred from the surface of the roller 3 to the surface of the roller 5. Hence, the toner layer on the roller 3 is desirably transferred to the roller 5, as indicated by an arrow in FIG. 2. The roller 2 in rotation conveys the toner layer to a developing position where the roller 2 faces the drum 1. At the developing position, the toner is partly transferred to the drum 1 in order to develop a latent image electrostatically formed on the drum 1. The rest of the toner left on the drum 5 is stripped from the drum 5 by the roller 3 at the inlet of a nip between the drums 5 and 3. At the outlet of the nip, a stably charged toner layer is transferred from the roller 3 to the roller 5.

Assume that the toner layer is not transferred from the roller 5 to the drum 1, i.e., a white portion is developed. Then, if the toner layer whose charge condition has been varied due to friction between the roller 5 and the drum 1 is directly used for the next development, the resulting image is likely to be defective.

In the illustrative embodiment, the toner layer on the roller 5 and varied in charge condition, as stated above, is stripped off by the roller 3 and returned to the hopper 8. As a result, a toner layer charged by the doctor blade 4 to the expected polarity is transferred to the roller 5. Such a toner layer is conveyed to the developing position by the roller 5, so that defective images are eliminated.

In the toner layer on the roller 3, some particles are charged to a polarity (positive polarity in the embodiment) opposite to the expected polarity due to friction between the particles themselves. Should the toner layer including such undesirable particles be deposited on a latent image formed on the drum 1, the undesirable particles would deposit on and smear the non-image area or background of the drum 1.

In the embodiment, while the drum 1 is charged, the roller 5 is not charged and is maintained at a constant potential over the entire periphery thereof. Hence, when a bias voltage is applied from the DC power source 6 to the roller 5 in order to transfer the toner 7 to the drum 1, only the toner particles charged to the expected polarity, i.e., negative polarity are deposited on the roller 5. Consequently, the toner layer formed on the roller 5 includes a minimum number of particles charged to the opposite polarity and, therefore, scarcely smears the background of the drum 1.

Figure 3:
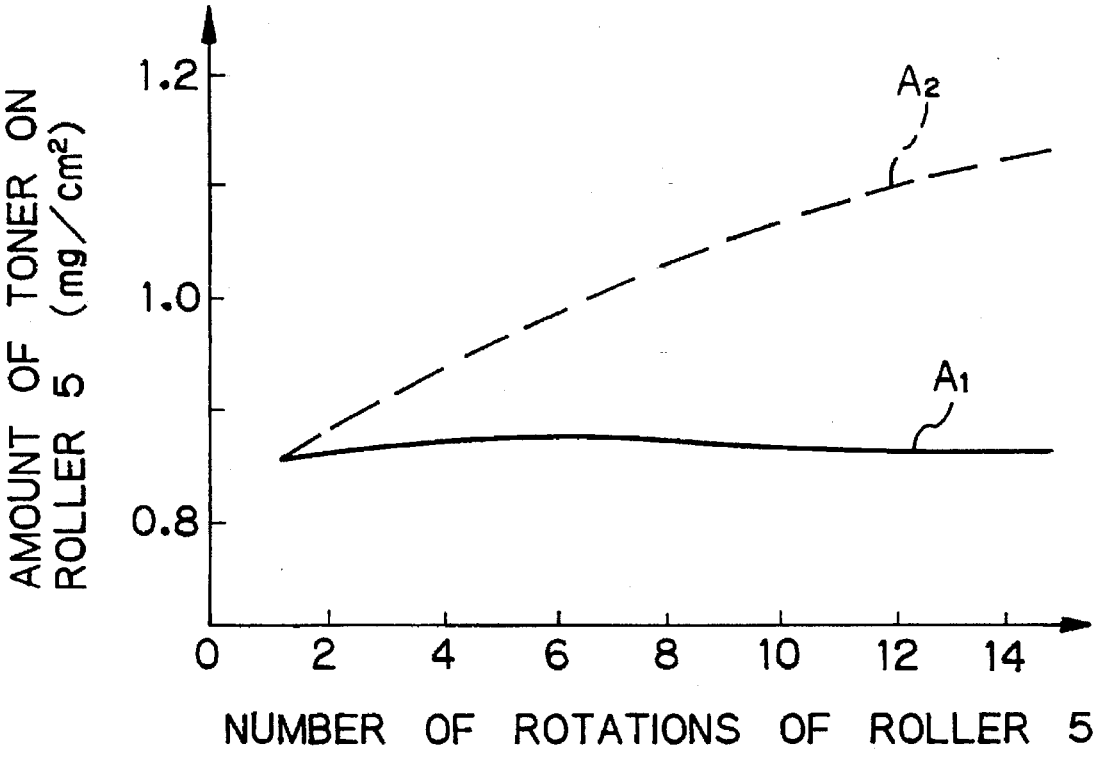
FIG. 3 is a graph representative of a relation between the number of rotations of a second developing roller included in the embodiment and the amount of toner deposited thereon.

Assume that the roller 5 is rotated while development is not effected in the developing device 2, i.e., while no toner is transferred from the roller 5 to the drum 1. Then, if the roller 3 does not strip the toner from the roller 5, the amount of toner on the roller 5 sequentially increase with an increase in the number of rotations of the roller 5, as indicated by a curve A2 in FIG. 3. In FIG. 3, a curve A1 is representative of a case wherein the toner is stripped from the roller 5 by the roller 3 as expected. In FIG. 3, the abscissa is representative of the numbers of rotations of the roller 5 and counted from a condition wherein no toner is present on the roller 5. Also, the ordinate is representative of the amounts of toner deposited on the roller 5 and measured at the developing position.

Figure 4A:
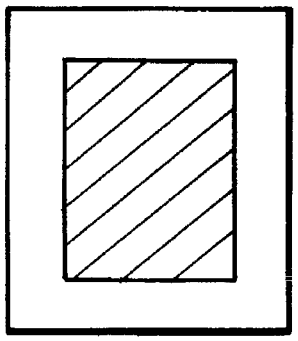
FIG. 4A and 4B respectively show a specific document image and a defective reproduction thereof attributable to defective toner removal.
Figure 4B:
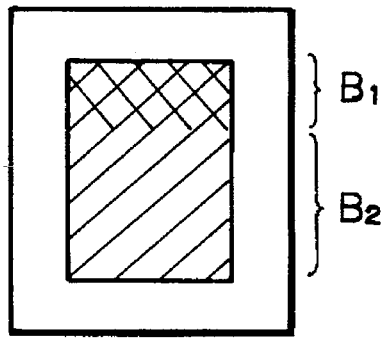

If the roller 5 starts developing a latent image formed on the drum 1 with the increased amount of toner, as shown in FIG. 3, the developed image will have a higher density only in a portion thereof initially developed by one rotation of the roller 5 and will, therefore, be defective. For example, assume that a solid latent image having a uniform image density, as shown in FIG. 4A specifically, is developed. Then, as shown in FIG. 4B, the resulting image has a density higher than a preselected density in a portion B1 thereof developed by the initial one rotation of the roller 5. In FIG. 4B, the portion B1 is followed by a portion B2 developed by the second and successive rotations of the roller 5.

A series of researches and experiments showed that the removal of the toner from the roller 5 by the roller 3 is noticeably susceptible to the fluidity of the toner 7; when the fluidity is short of a particular fluidity, the expected toner removal is not achievable. The fluidity of the toner 7 is effected by the silica content and zinc stearate content of the toner 7, the surface roughness of the roller 3, the bite of the rollers 3 and 7 into each other, and the content of coarse particles of the toner 7.

In the illustrative embodiment, the silica content was selected to be less than 2 wt % inclusive, the zinc stearate content was selected to be less than 2 wt % inclusive, the surface roughness of the roller 3 was selected to be less than 10 μm Rz inclusive in terms of a ten-point mean value as prescribed by JIS, and the bite of the rollers 3 and 5 into each other was selected to be 0.1 mm to 0.5 mm. However, these specific conditions were selected for purposes other than the purpose of enhancing the fluidity of the toner 7, as will be described. Even under these conditions, the content of toner particles greater in size than 12 μm inclusive was selected to be less than 10 vol % inclusive in order to provide the toner 7 with preselected fluidity.

The above silica content of less than 2 wt % inclusive obviates a decrease in density likely to occur when the silica content is great. At the same time, such a silica content prevents the rear (background) of a black solid portion of a negative latent image from appearing slightly black, i.e., a residual positive image. The zinc stearate content of less than 1 wt % inclusive eliminates a decrease in density likely to occur when the content is great. The surface roughness of the roller 3 less than 10 μm Rz inclusive protects the background from contamination by depositing an adequate amount of charge on the toner 7. The bite of the rollers 3 and 5 less than 0.5 mm inclusive is selected in order to reduce the required drive torque. Further, the lower limit of the bite is selected to be 0.1 mm in order to allow the rollers 3 and 5 to surely bite into each other even when the diameters of the rollers 3 and 5 are close to the tolerance in the negative direction, i.e., when the diameters of the rollers 3 and 5 are slightly small within the designed allowable range.

Figure 5:
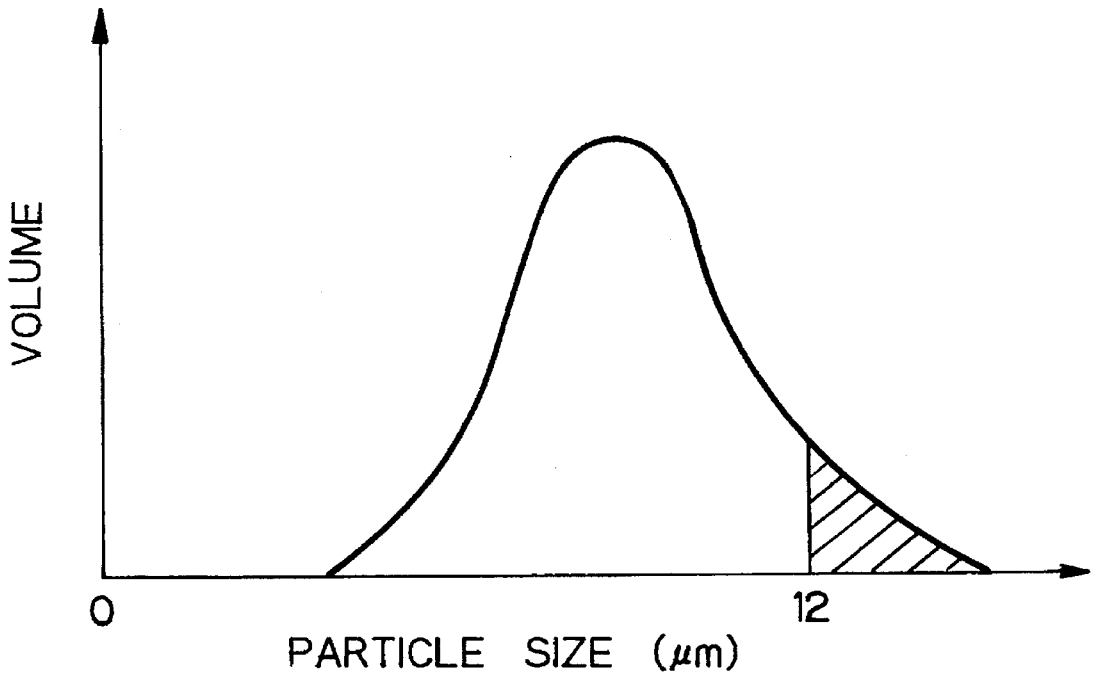
FIG. 5 is a graph indicative of a specific particle size distribution of toner.

The content of coarse toner particles was measured by an apparatus capable of measuring the grain size distribution of powder (E-Spart Analyzer (trade name) available from Hosokawa Micron Co., Ltd.). FIG. 5 shows a particle size distribution of toner measured with the above apparatus. The content of coarse toner particles was determines in terms of the ratio of the volume of particles greater than 12 μm inclusive (indicated by hatching in FIG. 5) to the total volume of the particles.

Figure 6:
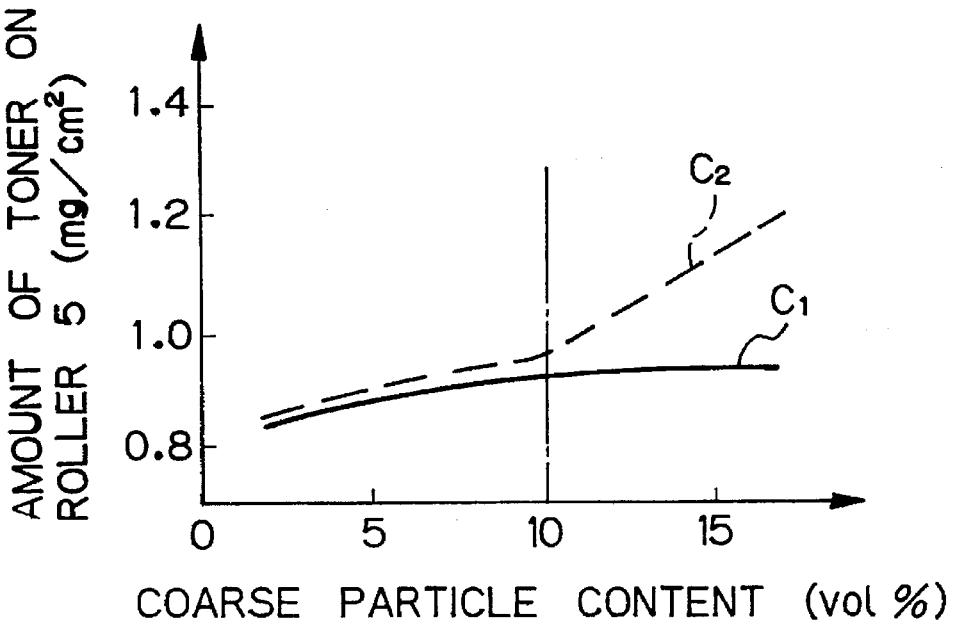
FIG. 6 is a graph showing a relation between the content of coarse toner particles and the amount of toner deposited on the second developing roller.

It was found by experiments that when the content of toner particles greater than 12 μm inclusive is less than 10 vol % inclusive under the previously stated other conditions, the toner 7 achieves the preselected fluidity and can be adequately stripped from the roller 5 by the roller 3. As a result, as shown in FIG. 6, substantially the same amount of toner is deposited on the roller 5 both when the number of rotations of the roller 5 is one (curve C1) and when it is ten (curve C2). In this condition, even when the roller 5 was rotated without feeding any toner to the drum 1, the subsequent developed image was free from defects. As also shown in FIG. 6, when the content of toner particles greater than 12 μm inclusive was greater than 10 vol % inclusive, the amount of toner present on the roller 5 sequentially increased with an increase in the number of rotations of the roller 5.

The silica content is another factor that effects the fluidity of toner, as stated previously. Specifically, the fluidity of toner decreases with a decrease in silica content. In light of this, in order to provide the toner 7 with the preselected fluidity, the silica content may be selected to be greater than 0.2 wt % inclusive under conditions selected for purposes other than the purpose for enhancing the fluidity of toner, i.e., a content of toner particles greater than 12 μm inclusive of less than 15 vol % inclusive, a zinc stearate content of less than 2 wt % inclusive, a surface roughness of the roller 3 less than 10 μm Rz inclusive in terms of the ten-point mean value, and a bite of the rollers 3 and 5 into each other ranging from 0.1 mm to 0.5 mm. It is to be noted that the content of toner particles greater than 12 μm of less than 15 vol % inclusive is successful to insure the reproducibility of thin lines.

Figure 7:
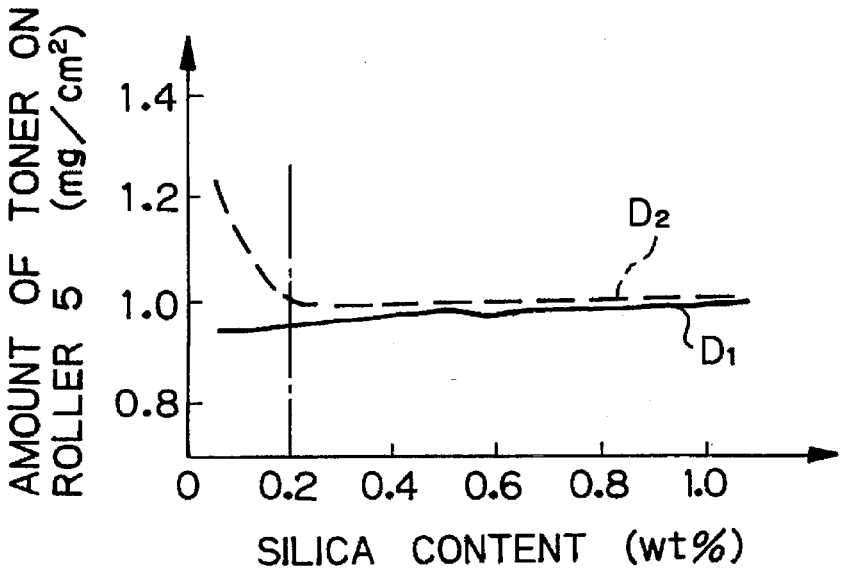
FIG. 7 is a graph showing a relation between the silica content of toner and the amount of toner deposited on the second developing roller.

As stated above, when the silica content is greater than 0.2 wt % inclusive under the above conditions, the toner 7 achieves the preselected fluidity and can be more positively stripped from the roller 5 by the roller 3, as determined by experiments. As shown in FIG. 7, substantially the same amount of toner is deposited on the roller 5 both when the number of rotations of the roller 5 is one (curve D1) and when it is ten (curve D2). Even when the roller 5 is rotated without feeding no toner to the drum 1, the subsequent developed image is free from defects. As also shown in FIG. 7, when the silica content is less than 0.2 wt %, the amount of toner present on the roller 5 sequentially increases with an increase in the number of rotations of the roller 5.

The fluidity of the toner 7 decreases with an increase in the zinc stearate content of the toner 7. In light of this, in order to provide the toner 7 with the preselected fluidity, the zinc stearate content may be selected to be less than 1.0 wt % inclusive under the conditions selected for purposes other than the purpose of enhancing the fluidity, i.e., a content of toner particles greater than 12 μm of less than 15 vol % inclusive, a silica content of less than 2 wt % inclusive, a surface roughness of the roller 3 less than 10 μm Rz inclusive in terms of the ten-point mean value, and a bite of the rollers 3 and 5 into each other ranging from 0.1 mm to 0.5 mm.

Figure 8:
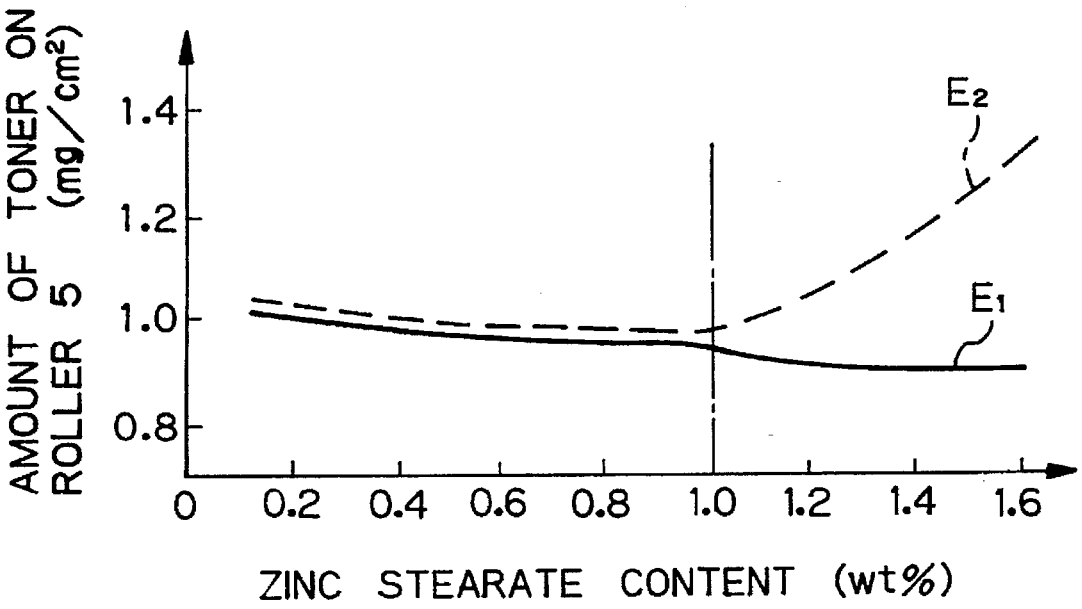
FIG. 8 is a graph showing a relation between the zinc stearate content of toner and the amount of toner deposited on the second developing roller.

When the zinc stearate content of the toner 7 is less than 1.0 wt % inclusive under the above conditions, the toner 7 achieves the preselected fluidity and can be more positively stripped from the roller 5 by the roller 3, as determined by experiments. As shown in FIG. 8, substantially the same amount of toner is deposited on the roller 5 both when the number of rotations of the roller 5 is one (curve E1) and when it is ten (curve E2). Even when the roller 5 is rotated without feeding any toner to the drum 1, the subsequent developed image is free from defects. As also shown in FIG. 8, when the zinc stearate content of the toner 7 is greater than 1.0 wt %, the amount of toner present on the roller 5 sequentially increases with an increase in the number of rotations of the roller 5.

The zinc stearate content of the toner 7 influences the adhesion of the toner 7 to the doctor blade 7 also, as will be described hereinafter. In FIG. 1, the doctor blade 4 made of metal magnetically contacts the magnetized surface of the roller 3. While the roller 3 is rotation, the toner 7 from the toner 7 is magnetically deposited on and conveyed by the roller 3. At this instant, the blade 4 levels the toner 7 on the roller 3 so as to form a uniform toner layer. In this condition, when the roller 3 is rotated for a long period of time, the toner adheres to the portion of the blade 4 contacting the roller 3. The adhesion of the toner 7 to the blade 4 is generally accounted for by the following mechanism, although the mechanism has not been proved yet. The toner nipped between the roller 3 and the blade 4 is subjected to friction attributable to the rotation of the roller 3. As this condition lasts a long period of time, the temperature is locally elevated. When the temperature exceeds the melting point of a resin (binder) contained in the toner, the toner melts and adheres to the blade 4.

Figure 9A:
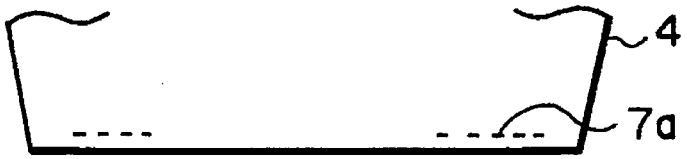
FIGS. 9A and 9B demonstrate how toner adheres to a doctor blade.
Figure 9B:
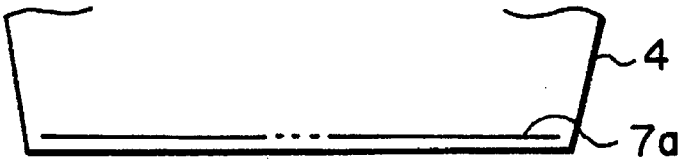

It is generally accepted that the above toner adhesion proceeds in a manner shown in FIGS. 9A and 9B. As shown in FIG. 9A, the toner 7 initially adheres to the edge of the blade 4 at several positions 7*a*. Subsequently, the adhesion spreads with the portions 7*a* serving as cores, as shown in FIG. 9B. The adhesion sometimes spreads over the entire blade 4. The thickness of the blade 4 increases in the portions where the toner adhered, thinning the toner layer. A decrease in the thickness of the toner layer directly translates into a decrease in image density, resulting in white stripes in an image. When the adhesion of the toner spreads over the entire blade 4, the entire image is reduced in density.

Figure 10:
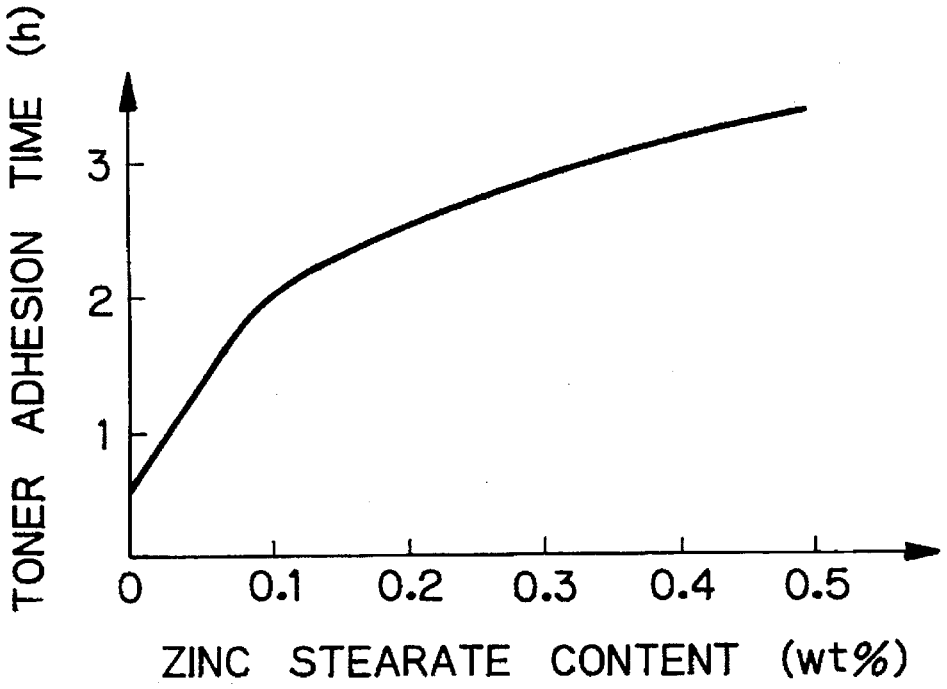
FIG. 10 is a graph representative of a relation between the zinc stearate content of toner and the toner adhesion time.
Figure 11:
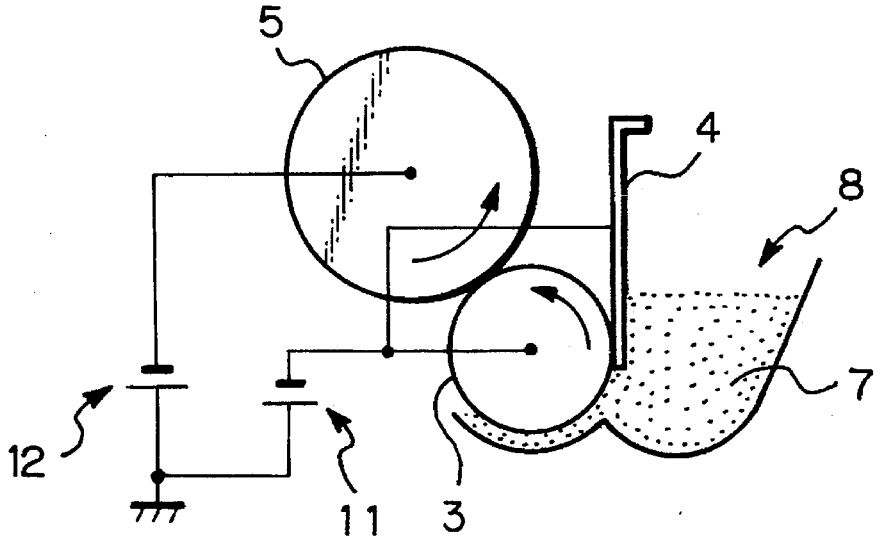
FIG. 11 is a section showing a specific arrangement for the measurement of the toner adhesion time.

FIG. 10 shows a relation between the zinc stearate content of toner and the toner adhesion time. The toner adhesion time indicated on the ordinate refers to a period of time which is counted as follows. As shown in FIG. 11, the rollers 3 and 5 are each positioned in a particular position, and −750 V and a −450 V are respectively applied to the rollers 3 and 5 from DC power sources 11 and 12. In this condition, the rollers 3 and 5 are caused to idle. The toner adhesion time refers to the interval between the time when the idling begins and the time when white stripes due to the cohesion of the toner are observed over the entire toner layer on the roller 3. When the toner adhesion time is 2 hours, no toner adhesion occurs even when 60, 000 images are produced, as determined by actual running tests. This, coupled with the graph of FIG. 10, suggests that the toner adhesion can be obviated if the zinc stearate content is greater than 0.1 wt % inclusive. This was experimentally confirmed with a content of toner particles greater than 12 μm inclusive of less than 15 vol % inclusive, a silica content of less than 2 wt % inclusive, a surface roughness of the roller 3 less than 10 μm Rz inclusive in terms of the ten-point mean value, and a linear velocity of the roller 3 ranging from 100 mm/sec to 250 mm/sec. Such a linear velocity range is selected because the amount of toner necessary on the roller 3 in order to stably charge the toner is about 0.3±0.1 g/cm$^2$, and such that the toner can be fed to the drum 1 moving at a linear velocity of 30 mm/sec to 80 mm/sec. Here, the roller 5 is assumed to move at substantially the same linear velocity as the drum 1.

Figure 12:
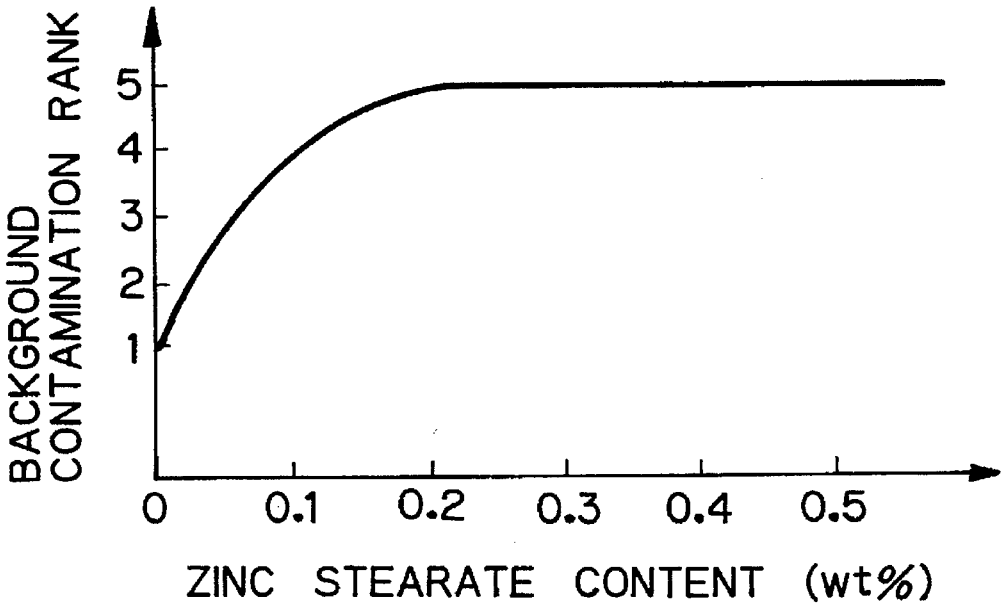
FIG. 12 is a graph showing a relation between the zinc stearate content of toner and the background contamination rank.

Further, the zinc stearate content of the toner 7 has influence on the contamination of the background. FIG. 12 shows a relation between the zinc stearate content and the rank of the background contamination of an image. The words "rank of background contamination" refer to the degree of background contamination to occur when a particular bias voltage is applied to each of the rollers 3 and 5. Rank 5, for example, means that no background contamination occurred. A standard rank is 4 when a standard bias voltage is applied. As FIG. 12 indicates, the degree of background contamination tends to decrease with an increase in zinc stearate content, although such a tendency has not been clearly accounted for. It will be seen that the standard rank is achievable if the zinc stearate content is greater than 0.1 wt % inclusive. This was experimentally determined when the toner 7 included particles greater than 12 μm inclusive in an mount of 15 vol % or less and had a silica content of 2 wt % or less, when the roller 3 had a surface roughness of 10 μm Rz or less in terms of the ten-point mean value, when the rollers 3 and 5 were respectively rotated at linear velocities of 100 mm/sec to 250 mm/sec and 30 mm/sec to 80 mm/sec, when a difference between the biases applied to the rollers 3 and 5 was 300 V to 700 V in absolute value, when the roller 3 had a volume resistance of $10^4$ Ωcm or above, and when the rubber forming the surface of the roller 5 had a smaller hardness than the surface of the drum 1.

In summary, in accordance with the present invention, a developer is provided with a preselected degree of fluidity. Hence, even when the same portion of the surface of a second developer carrier runs a plurality of times past a position where the developer carrier contacts a first developer carrier without any developer being fed from the second developer carrier to an image carrier, the first developer carrier can surely strip the developer from the second developer carrier. As a result, a developer on which a predetermined amount of charge is deposited is transferred from the first developer carrier to the second developer carrier. This successfully protects images from defects. Particularly, when the developer has a zinc stearate content of greater than 0.1 wt %, it is possible to prevent the developer from melting and adhering to a member which regulates the developer.

Various modifications will become possible for those skilled in the art after receiving the teachings of the present disclosure without departing from the scope thereof.

What is claimed is:

1. A device for developing a latent image electrostatically formed on an image carrier, comprising:

a first developer carrier for depositing a developer thereon;

a regulating member for regulating the amount of developer deposited on said-first developer carrier; and a second developer carrier having an elastic surface, and contacting said first developer carrier, while biting into said first developer carrier to a predetermined extent;

wherein the developer deposited on said first developer carrier and regulated by said regulating member is transferred to said second developer carrier and fed from said second developer carrier to the image carrier for thereby developing the latent image, and wherein the developer contains coarse particles of a size of at least 12 μm in an amount of not greater than 10 vol % of the developer, said developer having a silica content of not greater than 2 wt % and a zinc stearate content of not greater than 2 wt %, said first developer carrier having a surface roughness Rz of not greater than 10 μm in terms of a 10-point mean value as prescribed by JIS (Japanese Industrial Standards), and said first and second carriers biting into each other by 0.1 mm to 0.5 mm.

2. The device as claimed in claim 1, wherein the zinc stearate content of the developer is at least 0.1 wt % when the surface of said first developer carrier moves at a linear velocity of 100 mm/sec to 250 mm/sec.

3. A device for developing a latent image electrostatically formed on an image carrier, comprising:

a first developer carrier for depositing a developer thereon;

a regulating member for regulating the amount of developer deposited on said first developer carrier; and a second developer carrier having an elastic surface, and contacting said first developer carrier, while biting into said first developer carrier to a predetermined extent;

wherein the developer deposited on said first developer carrier and regulated by said regulating member is transferred to said second developer carrier and fed from said second developer carrier to the image carrier for thereby developing the latent image, and wherein the developer is a particulate developer having a silica content of at least 0.2 wt % and containing coarse particles in an amount of up to 15 vol %, said coarse particles having a size of at least 12 μm, and said developer containing zinc stearate of up to 2 wt %, said first developer carrier having a surface roughness Rz of not greater than 10 μm in terms of a ten-point mean value as prescribed by JIS, and said first and second developer carriers biting into each other by 0.1 mm to 0.5 mm.

4. A device for developing a latent image electrostatically formed on an image carrier, comprising:

a first developer carrier for depositing a developer thereon;

a regulating member for regulating the amount of developer deposited on said first developer carrier; and a second developer carrier having an elastic surface, and contacting said first developer carrier, while biting into said first developer carrier to a predetermined extent;

wherein the developer deposited on said first developer carrier and regulated by said regulating member is transferred to said second developer carrier and fed from said second developer carrier to the image carrier for thereby developing the latent image, and wherein the developer, as a particle material containing coarse particles of a size of at least 12 μm in an amount of up to 15 vol % of the particles, has a zinc stearate content of up to 1.0 wt % and a silica content of up to 2 wt %, said first developer carrier having a surface roughness Rz of up to 10 μm in terms of a ten-point mean value as prescribed by JIS, and said first and second developer carriers biting into each other by 0.1 mm to 0.5 mm.

* * * * *